US005487567A

United States Patent [19]

Volpe

[11] Patent Number: 5,487,567

[45] Date of Patent: Jan. 30, 1996

[54] PRINTING METHOD AND COPY-EVIDENT SECURE DOCUMENT

[75] Inventor: John R. Volpe, Stormville, N.Y.

[73] Assignee: Francois-Charles Oberthur Group, Paris, France

[21] Appl. No.: 874,188

[22] Filed: Apr. 24, 1992

[51] Int. Cl.[6] ..... B42D 15/00

[52] U.S. Cl. ..... 283/72; 283/58; 283/62; 283/67; 283/85; 283/93; 283/94; 283/902

[58] Field of Search ..... 283/58, 62, 67, 283/72, 85, 93, 94, 902

[56] References Cited

U.S. PATENT DOCUMENTS

| | | |
|---|---|---|
| 734,135 | 7/1903 | Porter . |
| 776,515 | 12/1904 | Ives . |
| 1,002,600 | 9/1911 | Morris et al. . |
| 1,114,346 | 10/1914 | Farmer . |
| 1,428,278 | 9/1922 | Dow . |
| 1,689,302 | 10/1928 | Smith . |
| 1,692,405 | 11/1928 | Freeman . |
| 1,996,539 | 4/1935 | Dufay . |
| 2,850,825 | 9/1958 | Grants . |
| 2,952,080 | 9/1960 | Avakian et al. . |
| 3,471,172 | 10/1969 | Bayha . |
| 3,675,948 | 7/1972 | Wicker . |
| 3,831,007 | 8/1974 | Braun . |
| 3,852,088 | 12/1974 | Godlewski et al. . |
| 3,862,501 | 1/1975 | Jemseby . |
| 3,887,742 | 6/1975 | Reinnagel . |
| 4,025,673 | 5/1977 | Reinnagel . |
| 4,033,059 | 7/1977 | Hutton et al. . |
| 4,066,280 | 1/1978 | La Capria . |
| 4,168,088 | 9/1979 | Somlyody . |
| 4,210,346 | 7/1980 | Mowry, Jr. et al. . |
| 4,227,719 | 10/1980 | McElligott et al. . |
| 4,227,720 | 10/1980 | Mowry, Jr. et al. . |
| 4,265,469 | 5/1981 | Mowr, Jr. et al. . |
| 4,310,180 | 1/1982 | Mowry, Jr. et al. . |
| 4,341,404 | 7/1982 | Mowry, Jr. et al. . |
| 4,351,547 | 9/1982 | Brooks, II . |
| 4,579,370 | 4/1986 | Corwin et al. . |
| 4,582,346 | 4/1986 | Caprio et al. . |
| 4,588,212 | 5/1986 | Castagnoli . |
| 5,018,767 | 5/1991 | Wicker . |
| 5,171,040 | 12/1992 | Orndorff . |

FOREIGN PATENT DOCUMENTS

| | | |
|---|---|---|
| 1070731 | 1/1980 | Canada . |

*Primary Examiner*—Mark Rosenbaum
*Attorney, Agent, or Firm*—Davis Hoxie Faithfull & Hapgood

[57] ABSTRACT

Disclosed is a method of providing a copy-evident feature to documents and the documents produced thereby. The process allows the printing of a novel security design which is difficult to see with the naked eye when casually inspecting the document, but which will be immediately apparent in a copy if the document is photocopied or transmitted via facsimile.

51 Claims, 4 Drawing Sheets

PRINTING METHOD AND COPY-EVIDENT SECURE DOCUMENT

FIELD OF THE INVENTION

The present invention relates to an improved method of printing a pattern for providing a copy-evident security feature to documents, and to the documents produced thereby. More particularly, the new process allows the imprinting of a security message which is difficult to see with the naked eye when making a casual inspection of the document, but which will be immediately apparent in a copy if the document is photocopied or reproduced via facsimile.

BACKGROUND OF THE INVENTION

Several ways to reduce the chances of forging documents by methods, such as photocopying, already exist in the prior art. For example U.S. Pat. Nos. 4,227,720 and 4,310,180 disclose a system for protecting photolithographically prepared documents which employs a masked warning mark that is said to clearly appear on copies due to the inability of color copiers to integrate a composite pattern of big and little dots. On the original document, the mark is at least partially concealed from the casual observer. The system utilizes a mask having small dots of color density below the color reproductive density of the copier, while the overlay of the mask and warning phrase has larger dots of color density that exceeded the color reproductive density of the copier. Depending on the quality of the printing and the copier, it has been observed that in some cases the warning mark does not always clearly appear when a document is photocopied.

Also well-known in the prior art are methods for accurately printing very fine lines and other elements such as by intaglio printing, which is generally illustrated in FIG. 1 and discussed further below. Intaglio printing has been previously used to imprint security images into documents of value as disclosed in U.S. Pat. No. 4,033,059. In that patent, the pattern elements defining the image portions differ in depth or orientation from those elements forming the background. The object is to make a document in which the ability to discern the image portion from the background varies noticeably depending upon the angle of view and the orientation of the document, a characteristic not passed on to copies of the document. Both latent and transient images can be used to achieve this object. As viewed from a direction normal to the document surface, the latent image blends visually with the background. However, when the document is viewed at an acute angle to its surface, the latent image is readily recognizable in contrast to the background. The transient image is discernable when the document is viewed from a direction normal to its surface but disappears as the angle of view becomes acute. Whether a transient or latent image is used, copies of the document will not have the characteristic of a changing relationship between the contrast of the image portion with respect to the background as a function of changing angle of view. Conversely, as shown in U.S. Pat. No. 1,002,600, it is also known to provide distinctive marks which consist of lined elements produced at angles to the lines of the ground-work, which marks are "invisible" except when inspected through a special detector.

Our co-pending application, entitled, "Intaglio Printing Method and Secure Document Having a Variable Optical Image," provides a further improvement on the method of intaglio printing for secure documents. In that application, a composite design is engraved into an intaglio printing plate which is mounted on a roller and then coated with reflective intaglio ink and then pressed into a document substrate. Depending on the angle of view of the observer, one design of the composite design will reflect light and be immediately apparent, while the other design will blend substantially with the substrate surface. A photocopy or facsimile of the design will lack these changing reflective qualities.

SUMMARY OF INVENTION

It is the principal object of this invention to provide an improvement for well-known printing methods in order to produce an original document that cannot be readily reproduced by methods, such as photocopying or reproduction via facsimile. Specifically, the application is directed to printing a unique design composed of horizontal and diagonal or vertical lines having equal width and depth into a substrate, such as paper, using either intaglio or photolithographic printing techniques. Because the lines of both the image design as well as the background design are fine in width and pitch, it is difficult to distinguish with the naked eye the image design from the background design on casual inspection of the composite design which appears in a document. Documents according to the present invention may have all the standard security features typical of intaglio or photolithographic printing plus an image design which is a security message or warning phrase which becomes evident in any copies made of the original.

One aspect of the present invention is to print a security message on standard paper such as that used in laser printers and the like using either the improved intaglio or photolithographic printing methods of the invention. The resulting paper may be used in a multitude of environments in which it is desirable to generate documents which cannot be readily copied or sent via facsimile without detection. Some examples, without limitation, are doctor's prescriptions, security documents, vital records, music sheets, gift checks, coupons, confidential business records of any type, official documents, and the like.

DETAILED DISCUSSION

Figure 1:
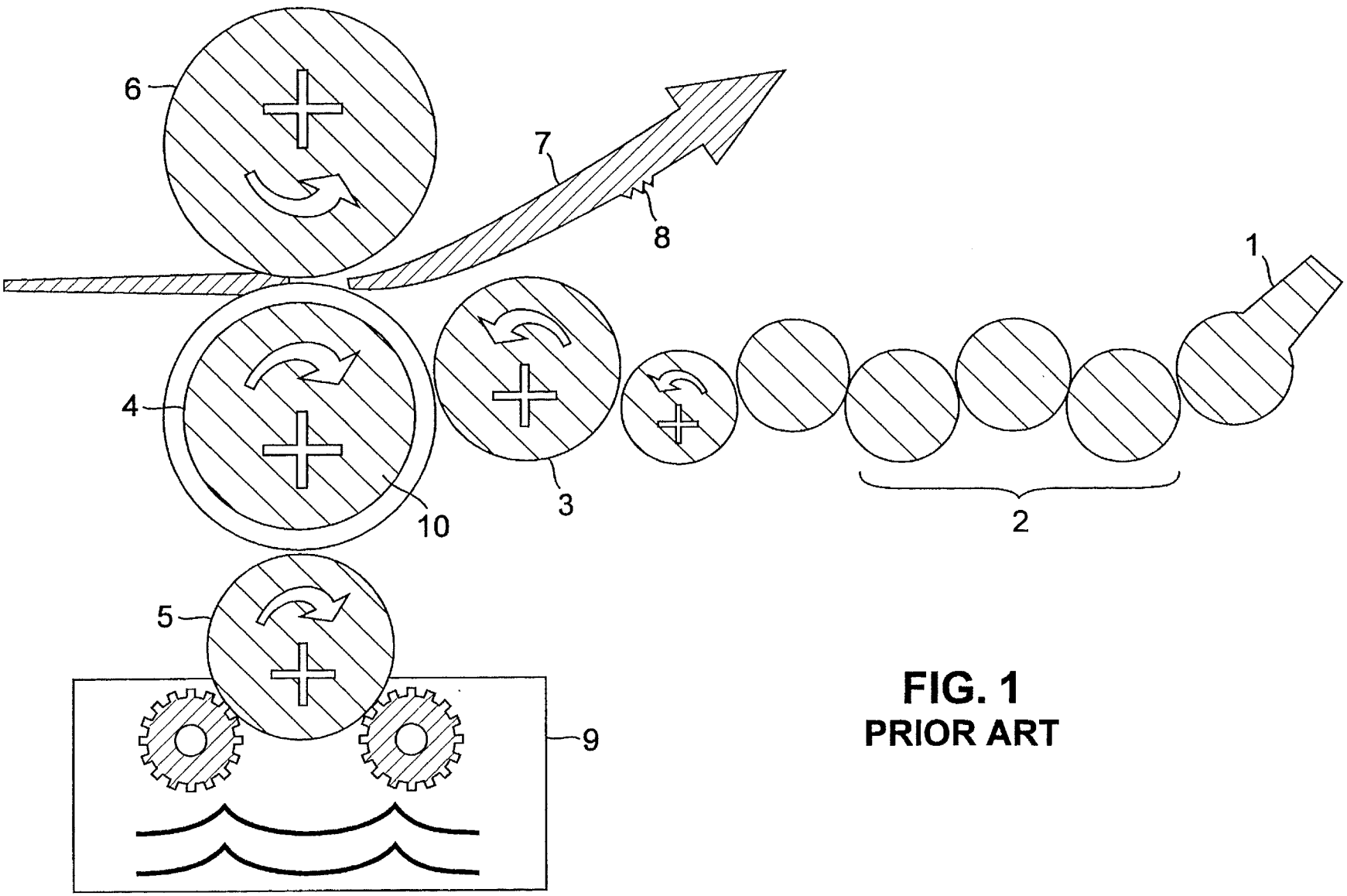
FIG. 1 PRIOR ART
FIG. 1 illustrates the prior art intaglio printing process.

For illustrative purposes, the invention will be described utilizing the intaglio printing process but it will be understood by those skilled in the art that other printing methods such as photolithography may be employed successfully. As illustrated in the intaglio process of FIG. 1, the ink fountain 1 supplies ink to several intermediate transfer rollers 2 that act to even out the supply flow of ink. A final ink transfer roller 3 which has a geometry that follows the surface of the printing plate 4 then fills the plate with ink. A wiping roller 5 utilizes a chemical wiping system 9 or wiping paper to wipe the excess ink off the surface of a plate or several identical plates 4 leaving ink in the intaglio portions, i.e. those portions which have been etched, of the printing plate 4. When paper, or another substrate having a flat surface 7, passes between the impression roller 6 and the plate 4 located on the plate cylinder 10, the ink is transferred from the intaglio lines of the plate 4 to form raised lines of ink on the paper, as shown in cross-sectional view by triangles 8 in FIG. 2 (not drawn to scale).

Attached to the plate cylinder 10 are one or more identical plates 4 that makeup the design which is to be printed on the paper. The die or matrix of the printing plate 4, which can be composed of copper, steel, or any other metal commonly used by high security engravers for intaglio printing, can be engraved into the metal surface to different depths.

Traditionally, the original designs used for security purposes were created by security printers using a drawing technique known as "linework" as discussed below. A composite design results from superimposing a distinct, original engraved image on another image while the orientation of both images is maintained. Thereafter, both images are incorporated and preserved in the same original master.

More frequently, the metal printing plate is engraved by chemical etching, which consists of exposing the drawing onto a film that itself is later transferred onto a photoresist on the metal. Specifically, certain insulated areas of the metal which are protected by exposed photoresist are not attacked by the acid used in etching and therefore protect the metal plate. The unexposed photoresist is washed off, and the acid etches into the metal surface of the plate either a tapered or V-shaped format depending upon the width of the lines. For example, a typical line having a width of 0.05 mm will have a depth of around 30 microns. An additional factor which effects the depth of the engraving is the amount of contact time between the acid and the metal. As a result, the drawing is etched into the metal.

In the alternative, manual or hand engraving using a graver or dragging tools may also be utilized to render a depth of 20 to 130 microns in the metal. These and other techniques for preparing the intaglio printing plates are well known to those skilled in the art and as a result are not discussed further herein.

Figure 2:
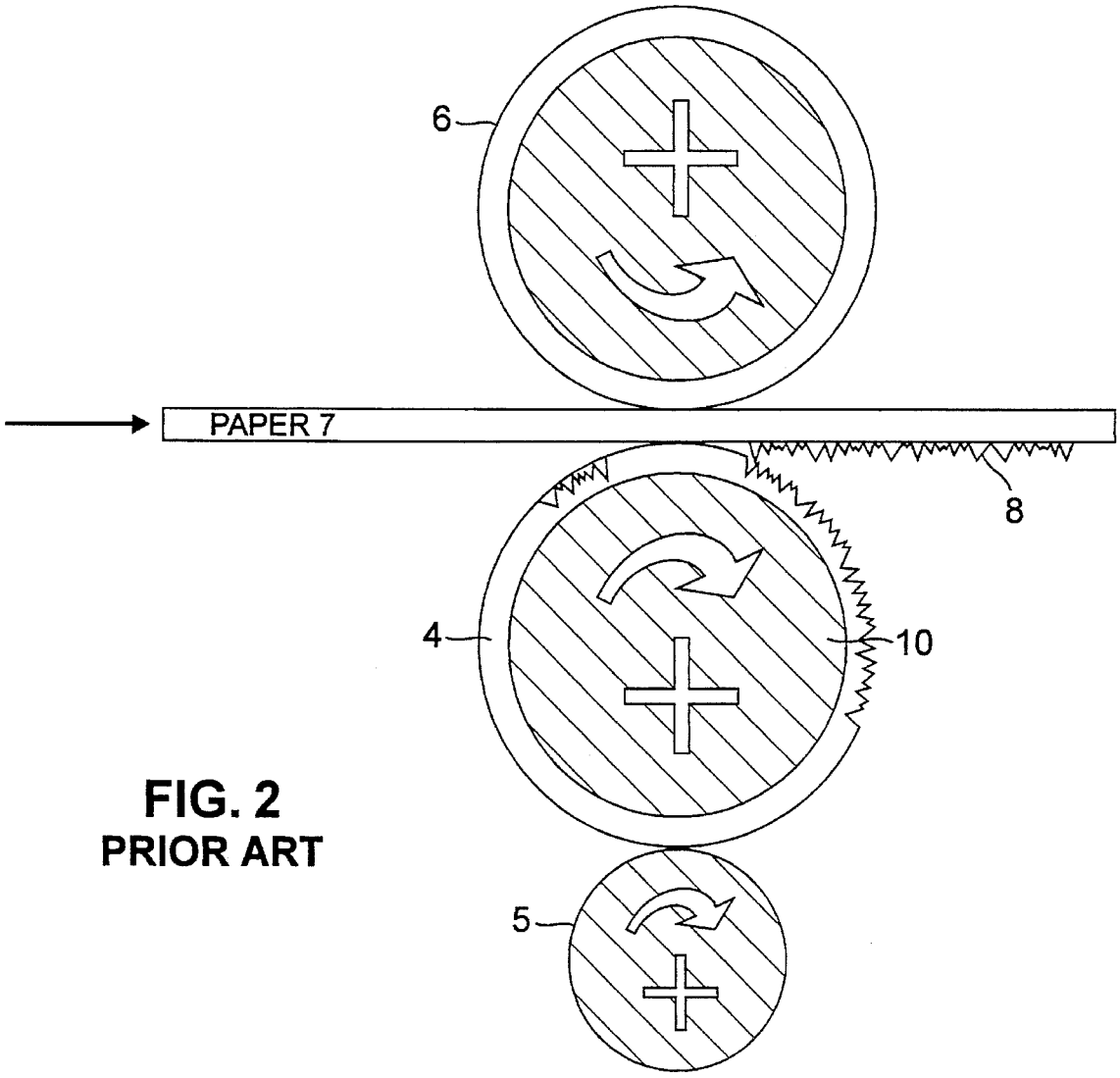
FIG. 2 PRIOR ART
FIG. 2 is an enlarged view of the paper before and after it passes between the impression roller 6 and the plate cylinder 10 during intaglio printing.

As shown in FIG. 2, after the printing plate 4 is wiped by the wiper roller system or wiping paper system 5, the highly viscous ink residue resides only in the recesses 11, i.e. the intaglio portions of the engraved printing plate 4. The paper 7, which passes between the pressure cylinder 6 and the plate cylinder 10, is thereby pressed into the ink-filled recesses 11 of the engraved plate 4 so as to replicate the pattern of the plate 4 in a raised impression 8 on the side of the paper adjacent to the printing plate 4. The transfer gives a different result depending on the depth and style of the line on the plate. Typically, the ink depth will be 50% of the line impression height, but this depth varies widely depending on the paper. The overall thickness of ink may vary between 15 to 50 microns.

Figure 3:
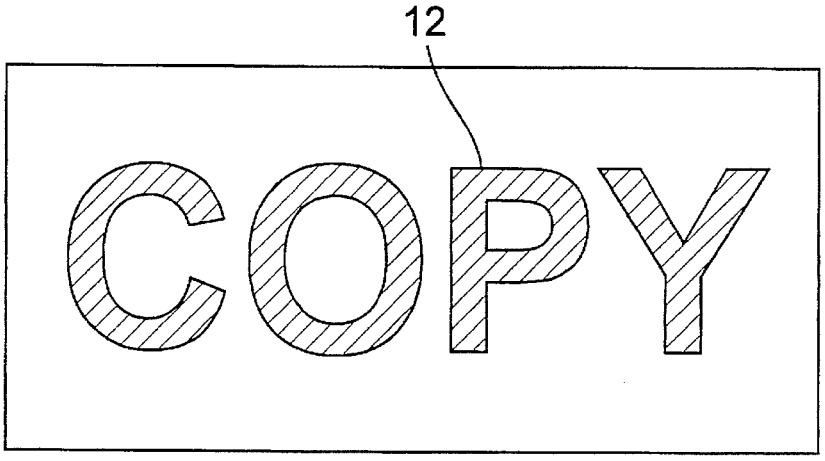
FIG. 3 shows a sample positive image of the COPY pattern for a document.

This invention may employ the well-known intaglio printing process as previously described and shown in FIGS. 1 and 2, modified as described below. As shown in FIG. 3, a warning phrase or image design is represented by generally parallel diagonal lines 12 having a pitch of between 10 and 200 lines per inch, preferably 65 lines per inch. In the example of FIG. 3, the image design or warning phrase "COPY" has been used; however, it will be readily understood that any other security message may be used as the image design. The lines 12, are angled between 10° and 175°,and preferably between 45° and 60° with respect to the background lines 13. The lines 12 have a width of approximately 0.001 inches and a depth which ranges between approximately 0.001 and 0.005 inches. A presently preferred depth is 0.002 inches. The lines 12 and 13 are approximately equal in depth, meaning the height to which the lines project in a direction perpendicular to the surface of either the substrate or the printing plate.

Figure 4:
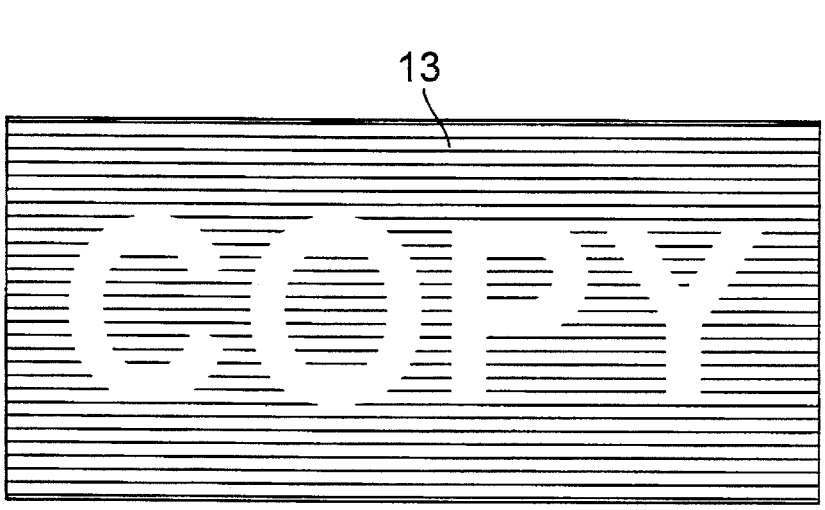
FIG. 4 demonstrates the image of the background having a horizontal lineal pitch, which is understood to mean the number of lines per inch.

FIG. 4 illustrates a background design 14, which borders the image design. The background design 14, is a negative representation of the image design or warning phrase 12, composed of generally parallel horizontal lines 13 that cover the plate surface in the area excluded by the image design 12. These horizontal lines 13 have a pitch of between 10 and 200 lines per inch, a width of approximately 0.001 inches, and a depth ranging between 0.001 and 0.005 inches, preferably 0.002 inches.

Figure 5:
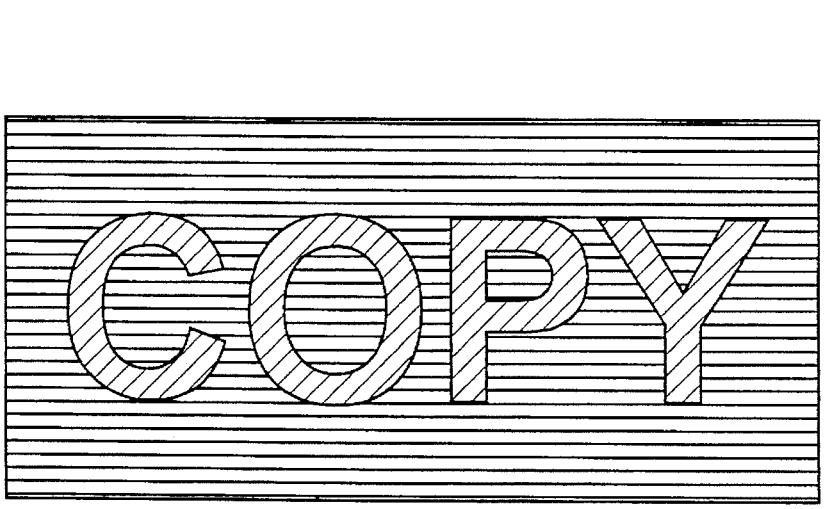
FIG. 5 shows a composite document according to the present invention made with two screens by superimposition of the screen pattern of FIG. 3 with the border of FIG. 4.

The designs of FIGS. 3 and 4 are superimposed to form a composite design 15 shown in FIG. 5. On FIGS. 3, 5, and 6, a line is shown around the image design elements for illustrative purposes only. The use of such a line is not part of the invention and indeed will defeat the object of making the warning phrase or image design difficult to distinguish on casual naked eye examinations of the original document.

Figure 6:
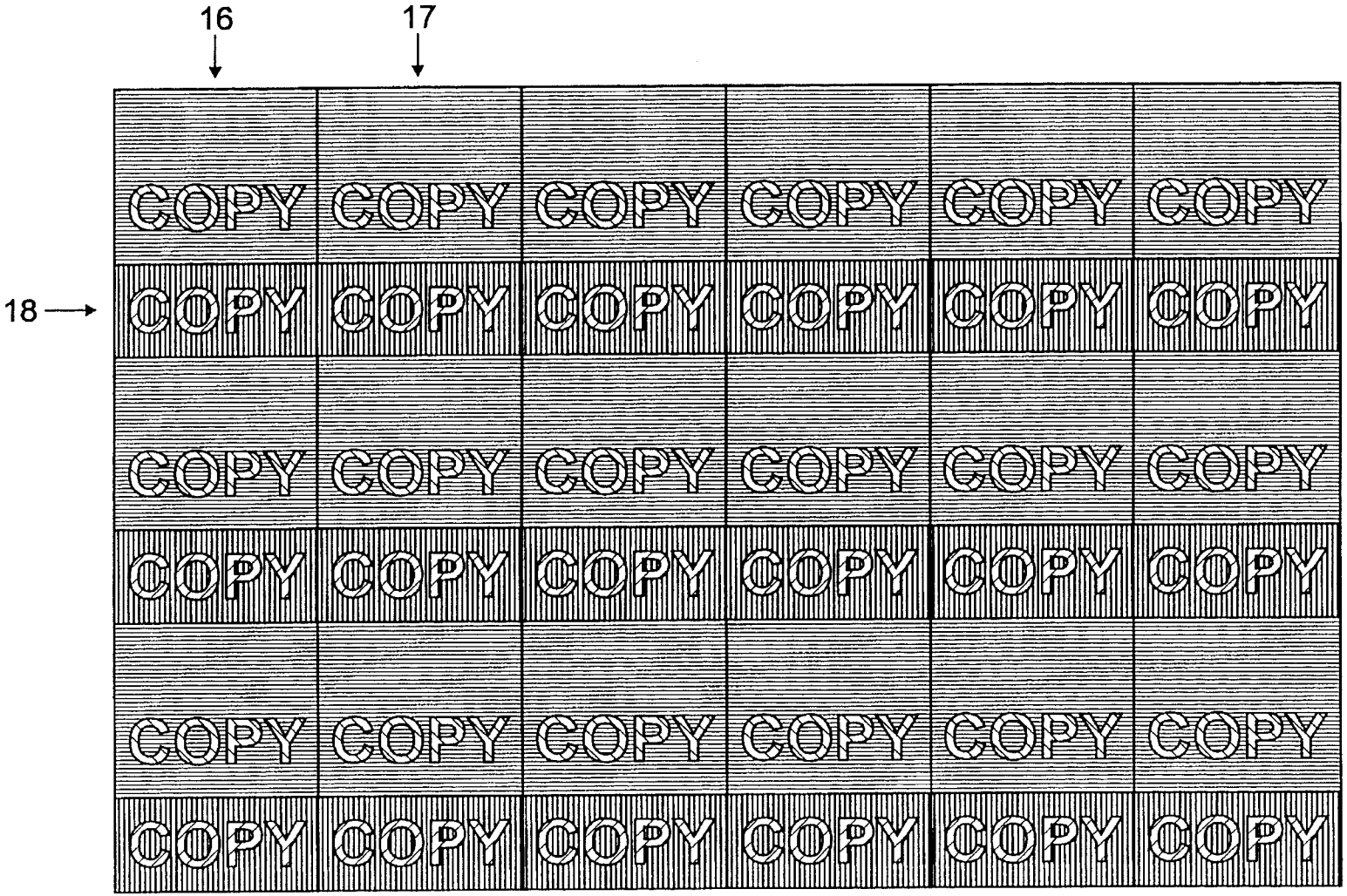
FIG. 6 illustrates a document printed with a plurality of composite designs varying in size and varying in the orientation of the lines comprising the image designs and background designs.

A secure document preferably includes more than one composite design, whereby the lines of at least one composite design are aligned at an angle with respect to the corresponding lines of another composite design. Most preferably, the lines of each composite design are aligned 90° out of phase with respect to any adjacent composite design as shown in FIG. 6. The composite design 16 is shown with horizontal background lines and the adjacent composite designs 17 and 18 are shown with vertical background lines. Also, the size of the various composite designs may be varied as shown, for example, by composite designs 16 and 18.

Each composite design is then preferably chemically etched into the metal printing plate 4. As earlier described, the composite designs may be engraved into the metal via any of the aforementioned well-known techniques. The plate is then rounded into a cylindrical configuration and attached to the printing cylinder 10.

As the paper 7 passes through the intaglio printing process of FIG. 2, the design of FIG. 5 is impressed into the document. Although it may not be visually apparent to the casual observer, the resulting warning phrase or image design will appear on a document reproduced by a typical photocopier or facsimile machine. This phenomenon occurs as a result of the photocopier's or facsimile machine's inability to accurately resolve the resulting composite design owing to the change in direction of the respective lines which form the image design and the background design. The use of multiple composite designs, aligned out of phrase with each other will enhance the effectiveness of the warning phrase or image design by making the document insensitive to its position on a photocopier or facsimile machine. Thus, if a photocopier has better line resolution characteristics for vertical lines rather than horizontal lines, the use of multiple composite designs will insure the occurrence of the warning phrase or image design in any photocopy or facsimile.

This phenomenon will work with printing with most colors. However, it appears to work best with darker colors, such as purple, brown, olive, black, and the like. For use with laser printer paper and the like, the paper is printed with linework such as that shown in FIGS. 5 and 6. When the paper is printed with a laser printer, for example, the resulting document cannot be readily photocopied or sent via facsimile.

It will be readily appreciated by those skilled in the art that although the foregoing describes the use of an intaglio printing process using an intaglio plate as the "master" for producing the secure documents, the use of other printing methods will require that other media be used as the master. Also, depending on the printing method chosen to carry out the invention, intermediate masters may be required, e.g. a film used to create an intaglio plate or a lithographic plate. Regardless of the method chosen, the resulting security documents which are made using such master will have a composite design which is made up of an image design surrounded or bordered by a background design as described above. Also as described above, the lines of said designs will be sufficiently fine in pitch and width so that the designs which result from printing a security document using such masters will have an image design which is difficult to distinguish from the background design on casual inspection of the security document with the naked eye. Such security documents will also exploit a photocopier's or facsimile machine's inability to accurately resolve the composite design. Thus, any copy made of such security document will have a readily apparent image design.

We claim:

1. A copy evident document which when copied results in a copy with a readily visually perceptible warning indicia that the copy is not an original document comprised of:

a document substrate having a surface;

a composite design on said surface comprised of an image warning design bordered by a background design;

said image warning design and said background design are each comprised of generally parallel printed lines of approximately equal width and depth on said surface with the lines of said image warning design being offset at an angle to the lines of said background design, said lines of said designs being sufficiently fine in pitch and width so as to make the image warning design difficult to distinguish from the background design on casual inspection of the document with the naked eye while at the same time exploiting a photocopier's or facsimile machine's inability to accurately resolve the composite design, thereby making the image warning design appear readily apparent upon casual inspection of any copy of the document.

2. A document as set forth in claim 1, wherein the lines of the composite design have a depth of between approximately 0.001 and 0.005 inches.

3. A document as set forth in claim 1, wherein the lines of the composite design have a depth of 0.002 inches.

4. A document as set forth in claim 1, wherein the lines of the image design are angled between 10° and 175° to the lines of the background design.

5. A document as set forth in claim 1, wherein the lines of the image design are angled between 45° and 60° to the lines of the background design.

6. A document as set forth in claim 1, wherein the lines of the composite design have a width of approximately 0.001 inches.

7. A document as set forth in claim 1, wherein the lines of the composite design have a pitch of between 10 and 200 lines per inch.

8. A document as set forth in claim 1, wherein the lines of the composite design have a pitch of approximately 65 lines per inch.

9. A copy-evident document which when copied results in a copy with a readily visually perceptible warning indicia that the copy is not an original document comprised of:

a document substrate having a surface;

a plurality of composite designs on said surface, each composite design comprised of an image warning design bordered by a background design, said image warning design and said background design are each comprised of generally parallel printed lines of approximately equal width and depth on said surface with the lines of said image warning design being offset at an angle to the lines of said background design, said lines of at least one of such composite designs being aligned 90° out of phase with respect to the corresponding lines of another composite design, said lines of said designs further being sufficiently fine in pitch and width so as to make the image warning designs difficult to distinguish from the background designs on casual inspection of the document with the naked eye while at the same time exploiting a photocopier's or facsimile machine's inability to accurately resolve the composite designs, thereby making at least one image warning design appear readily apparent upon casual inspection of any copy of the document.

10. A document as set forth in claim 9, wherein the lines of the composite design have a depth of between approximately 0.001 and 0.005 inches.

11. A document as set forth in claim 9, wherein the lines of the composite design have a depth of 0.002 inches.

12. A document as set forth in claim 9, wherein the lines of the image design are angled between 10° and 175° to the lines of the background design.

13. A document as set forth in claim 9, wherein the lines of the image design are angled between 45° and 60° to the lines of the background design.

14. A document as set forth in claim 9, wherein the lines of the composite design have a width of approximately 0.001 inches.

15. A document as set forth in claim 9, wherein the lines of the composite design have a pitch of between 10 and 200 lines per inch.

16. A document as set forth in claim 9, wherein the lines of the composite design have a pitch of approximately 65 lines per inch.

17. A copy-evident document which when copied results in a copy with a readily visually perceptible warning indicia that the copy is not an original document comprised of:

a document substrate having a surface;

a plurality of composite designs on said surface, each composite design comprised of an image warning design bordered by a background design;

said image warning design and said background design are each comprised of generally parallel printed lines of approximately equal width and depth on said surface with the lines of said image warning design being offset at an angle to the lines of said background design, the lines of at least one composite design being aligned at an angle with respect to the corresponding lines of another composite design, said lines of said designs being sufficiently fine in pitch and width so as to make the image warning designs difficult to distinguish from the background designs on casual inspection of the document with the naked eye while at the same time exploiting a photocopier's or facsimile machine's inability to accurately resolve the composite design, thereby making at least one image warning design appear readily apparent upon casual inspection of any copy of the document.

18. A document as set forth in claim 17, wherein the lines of the composite designs have a depth of between approximately 0.001 and 0.005 inches.

19. A document as set forth in claim 17, wherein the lines of the composite designs have a depth of 0.002 inches.

20. A document as set forth in claim 17, wherein the lines of at least one image design are angled between 10° and 175° to the lines of the background design.

21. A document as set forth in claim 17, wherein the lines of at least one image design are angled between 45° and 60° to the lines of the background design.

22. A document as set forth in claim 17, wherein the lines of the composite designs have a width of approximately 0.001 inches.

23. A document as set forth in claim 17, wherein the lines of the composite design have a pitch of between 10 and 200 lines per inch.

24. A document as set forth in claim 17, wherein the lines of the composite design have a pitch of approximately 65 lines per inch.

25. A master for producing copy-evident documents which when copied results in a copy with a readily visually perceptible warning indicia that the copy is not an original document comprising:

a surface;

at least one composite design on said surface comprised of an image warning design bordered by a background design, said image warning design and said background design are each comprised of generally parallel lines of approximately equal width and depth on said surface with the lines of said image warning design being offset at an angle to the lines of said background design, said lines of said designs being sufficiently fine in pitch and width so as to make the resulting image warning design difficult to distinguish from the resulting background design on casual inspection of the resulting document with the naked eye while at the same time exploiting a photocopier's or facsimile machine's inability to accurately resolve the resulting composite design, thereby making the image warning design appear readily apparent upon casual inspection of any copy of the resulting document.

26. A master as set forth in claim 25, wherein the master is an intaglio plate.

27. A plate as set forth in claim 26, wherein the lines of the composite design have a depth of between approximately 0.001 and 0.005 inches.

28. A plate as set forth in claim 26, wherein the lines of the composite design have a depth of 0.002 inches.

29. A master as set forth in claim 25 wherein the lines of the image design are angled between 10° and 175° to the lines of the background design.

30. A master as set forth in claim 25, wherein the lines of the image design are angled between 45° and 60° to the lines of the background design.

31. A master as set forth in claim 25, wherein the lines of the composite design have a width of approximately 0.001 inches.

32. A master as set forth in claim 25, wherein the lines of the composite design have a pitch of between 10 and 200 lines per inch.

33. A master as set forth in claim 25, wherein the lines of the composite design have a pitch of approximately 65 lines per inch.

34. A master for producing copy-evident documents which when copied result in a copy with a readily visually perceptible warning indicia that the copy is not an original document comprising:

a surface;

a plurality of composite designs on said surface, each composite design comprised of an image warning design bordered by a background design, said image warning design and said background design are each comprised of generally parallel lines of approximately equal width and depth on said surface with the lines of said image warning design being offset at an angle to the lines of said background design, said lines of at least one of such composite designs being aligned 90° out of phase with respect to the corresponding lines of another composite design, said lines of said designs further being sufficiently fine in pitch and width so as to make the resulting image warning designs difficult to distinguish from the resulting background designs on casual inspection of the resulting document with the naked eye while at the same time exploiting a photocopier's or facsimile machine's inability to accurately resolve the resulting composite design, thereby making at least one image warning design appear readily apparent upon casual inspection of any copy of the resulting document.

35. A master as set forth in claim 34, wherein the master is an intaglio plate.

36. A plate as set forth in claim 35, wherein the lines of the composite design have a depth of between approximately 0.001 and 0.005 inches.

37. A plate as set forth in claim 35, wherein the lines of the composite design have a depth of 0.002 inches.

38. A master as set forth in claim 34, wherein the lines of the image design are angled between 10° and 175° to the lines of the background design.

39. A master as set forth in claim 34, wherein the lines of the image design are angled between 45° and 60° to the lines of the background design.

40. A master as set forth in claim 34, wherein the lines of the composite design have a width of approximately 0.001 inches.

41. A master as set forth in claim 34, wherein the lines of the composite design have a pitch of between 10 and 200 lines per inch.

42. A master as set forth in claim 34, wherein the lines of the composite design have a pitch of approximately 65 lines per inch.

43. A master for producing copy-evident documents which when copied result in a copy with a readily visually perceptible warning indicia that the copy is not an original document comprising:

a surface;

a plurality of composite designs on said surface, each composite design comprised of an image warning design bordered by a background design;

said image warning design and said background design are each comprised of generally parallel lines of approximately equal width and depth on said surface with the lines of said image warning design being offset at an angle to the lines of said background design, the lines of at least one composite design being aligned at an angle with respect to the corresponding lines of another composite design, said lines of said designs being sufficiently fine in pitch and width so as to make the resulting image warning designs difficult to distinguish from the resulting background designs on casual inspection of the resulting document with the naked eye while at the same time exploiting a photocopier's or facsimile machine's inability to accurately resolve the resulting composite design, thereby making at least one image warning design appear readily apparent upon casual inspection of any copy of the resulting document.

44. A master as set forth in claim 43, wherein the master is an intaglio plate.

45. A plate as set forth in claim 44, wherein the lines of the composite designs have a depth of between approximately 0.001 and 0.005 inches.

46. A plate as set forth in claim 44, wherein the lines of the composite designs have a depth of 0.002 inches.

47. A master as set forth in claim 43, wherein the lines of at least one image design are angled between 10° and 175° to the lines of the background design.

48. A master as set forth in claim 43, wherein the lines of at least one image design are angled between 45° and 60° to the lines of the background design.

49. A master as set forth in claim 43, wherein the lines of the composite designs have a width of approximately 0.001 inches.

50. A master as set forth in claim 43, wherein the lines of the composite design have a pitch of between 10 and 200 lines per inch.

51. A master as set forth in claim 43, wherein the lines of the composite design have a pitch of approximately 65 lines per inch.

* * * * *